United States Patent [19]

Leiserson

[11] 4,431,041

[45] Feb. 14, 1984

[54] VIDEO CAMERA CASE

[76] Inventor: Steven G. Leiserson, 9190 Manor Dr., La Mesa, Calif. 92041

[21] Appl. No.: 407,380

[22] Filed: Aug. 12, 1982

[51] Int. Cl.[3] ..... A45C 11/38; A45C 13/04; A45F 3/12

[52] U.S. Cl. ..... 150/52 J; 190/102; 190/110; 190/122; 206/316; 224/264; 224/901; 224/908

[58] Field of Search ..... 150/52 J, 52 F, DIG. 1; 206/316, 578; 224/901, 908, 264; 190/49, 41 C, 52, 102, 110, 122 (U.S. only); D3/33

[56] References Cited

U.S. PATENT DOCUMENTS

| | | | |
|---|---|---|---|
| 1,415,776 | 5/1922 | Bourne | 150/52 J |
| 1,627,344 | 5/1927 | Scott | 150/52 F |
| 1,742,204 | 1/1930 | Finkelstein | 190/41 C |
| 2,136,357 | 11/1938 | Darling et al. | 150/52 J |
| 2,608,326 | 8/1952 | Spector | 224/264 |
| 2,638,041 | 5/1953 | Horydczak | 150/52 J X |
| 2,960,137 | 11/1960 | Lipsitz | 150/52 J |
| 3,536,237 | 10/1970 | Greenman | 224/264 X |
| 3,885,722 | 5/1975 | Robertson | 224/264 X |
| 4,000,769 | 1/1977 | Katz | 150/52 J |
| 4,128,194 | 12/1978 | Hinz | 224/901 X |
| 4,136,726 | 1/1979 | Lee | 150/52 J |
| 4,210,186 | 7/1980 | Belenson | 150/52 J |
| 4,260,004 | 4/1981 | Domke | 150/52 J X |
| 4,330,073 | 5/1982 | Clark | 150/52 J X |
| 4,361,258 | 11/1982 | Clark | 224/264 X |

FOREIGN PATENT DOCUMENTS

| | | | |
|---|---|---|---|
| 1107950 | 5/1961 | Fed. Rep. of Germany | 224/908 |
| 2534553 | 2/1977 | Fed. Rep. of Germany | 150/52 J |
| 1263366 | 12/1961 | France | 224/908 |
| 8001755 | 9/1980 | Netherlands | 206/316 |

*Primary Examiner*—William Price
*Assistant Examiner*—Sue A. Weaver
*Attorney, Agent, or Firm*—Charmasson & Holz

[57] ABSTRACT

A case is provided specifically tailored to the shape and needs of a video camera and being characterized by a shaped frame of aluminum bands confined between an outer cover and an inner liner, the liner and the cover both being removable from the frame for washing and repair and being made of foam sandwiched between durable Nylon cloth. A specialized anti-slip strap and an accessory bag which is removably attached to the main body of the case are also features of note.

3 Claims, 11 Drawing Figures

FIG. 6
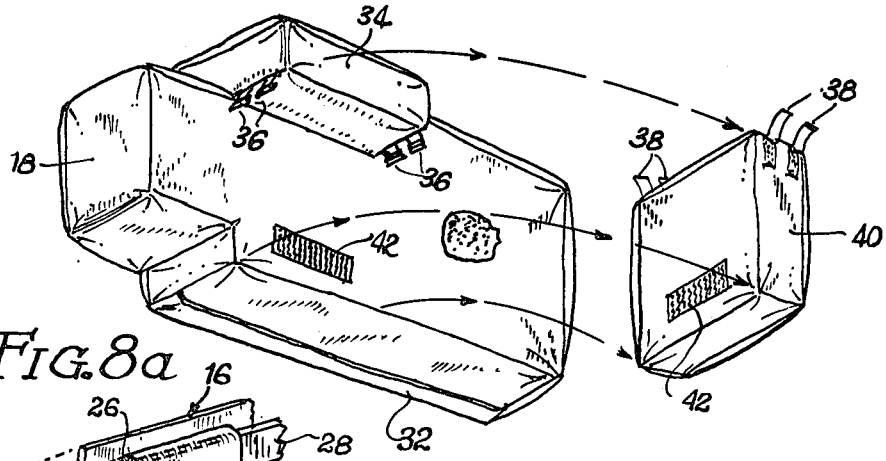
FIG. 8a
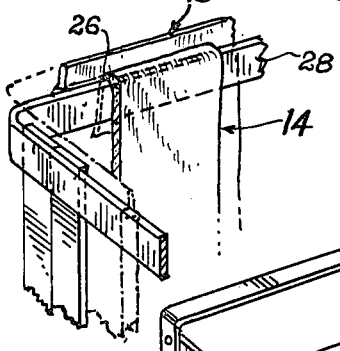
FIG. 7
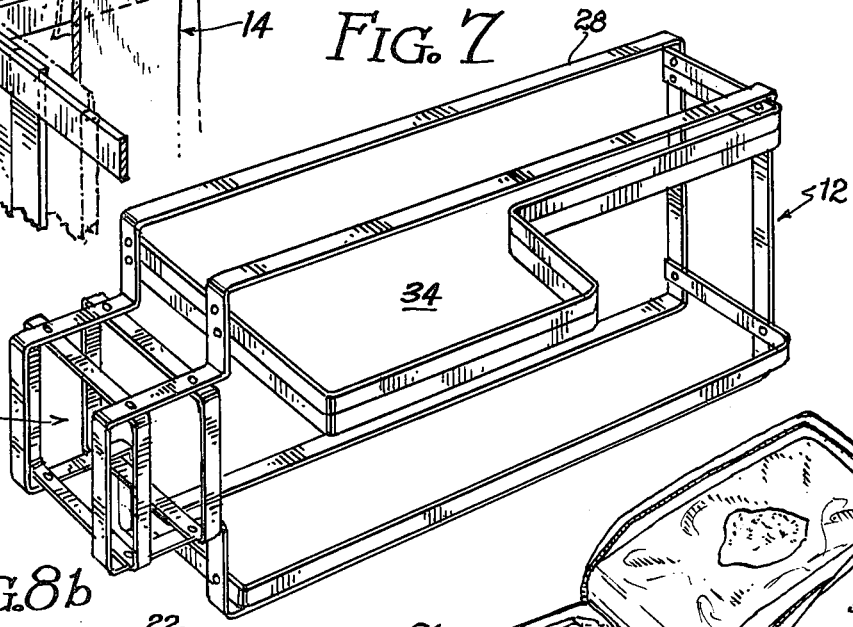
FIG. 8b
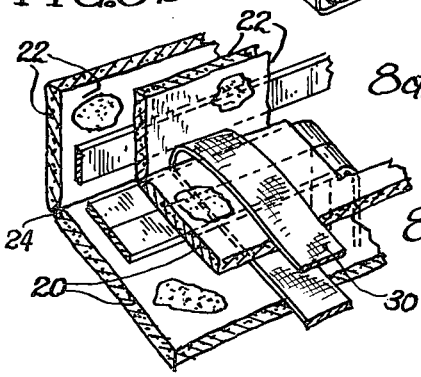
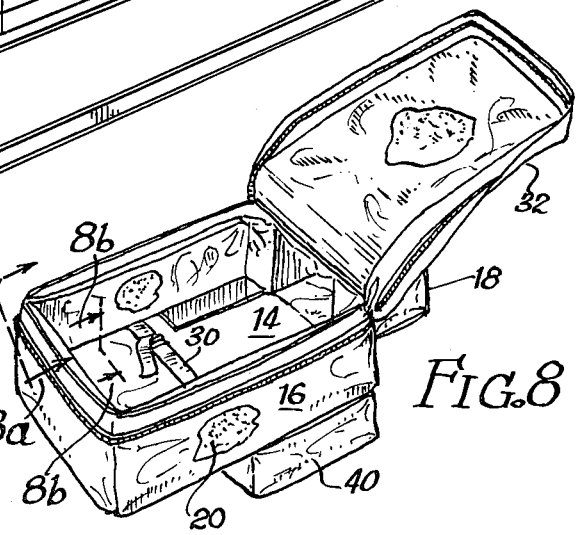
FIG. 8

VIDEO CAMERA CASE

BACKGROUND OF THE INVENTION

Video cameras are not only large and heavy for a portable instrument but are of course relatively delicate as well. Because of the nature of a video camera, it is also subject to considerable movement and being knocked around, inasmuch as one of largest groups to use portable video equipment extensively is television news reporters.

Obviously repairs to such a delicate piece of equipment can be expensive, and the constant movement of a typical camera in and out of news vans, cars, airplanes and the like is bound to cause some damage at some point. There is a need for a rugged, well-designed case which includes a rigid protective frame as well as a soft liner to prevent scratching the camera, and which is as lightweight as possible and designed to carry the camera and accessory equipment in the minimum possible space.

SUMMARY OF THE INVENTION

The present invention fulfills the above-stated need by providing a lightweight carrying case the core of which is a frame composed of aluminum bands riveted together in a formed cage closely following the contours of the camera itself. Inside the frame is a liner composed of sheets of foam bonded on both sides by tough, lightweight cloth. The liner laps over the edges of the frame and in the preferred embodiment is also strapped to the frame so that it is removable for washing and repair but very securely mounted when in use.

The exterior of the case is of the same basic construction as the liner, having a core layer of half-inch thick foam sewn between Nylon cloth. A specialized shoulder strap is soft to the shoulder, anti-skid and incorporates, by nature of its construction, anti-shock features, and a hand-carrying handle is provided as well. An accessory pouch releasably attaches to the side of the body of the case, and the cover itself is removable from the frame by virtue of a zippered side so that it too can be washed, repaired or replaced.

BRIEF DESCRIPTION OF THE DRAWINGS

FIG. 1(*a*) is a cut-away detail showing the shoulder strap construction;

FIG. 6 is a perspective taken below the horizontal illustrating the removability of the accesssory pouch;

FIG. 7 is a perspective view of the banded frame;

FIG. 8 illustrates the openable nature of the side of the frame cover;

FIG. 8(*a*) is a section taken along line 8(*a*)—8(*a*); and

FIG. 8(*b*) is a detail taken along line 8(*b*)—8(*b*) of FIG. 8 illustrating particularly the way in which the liner strap engages members of the banded frame.

DETAILED DESCRIPTION OF THE PREFERRED EMBODIMENT

Figure 1:
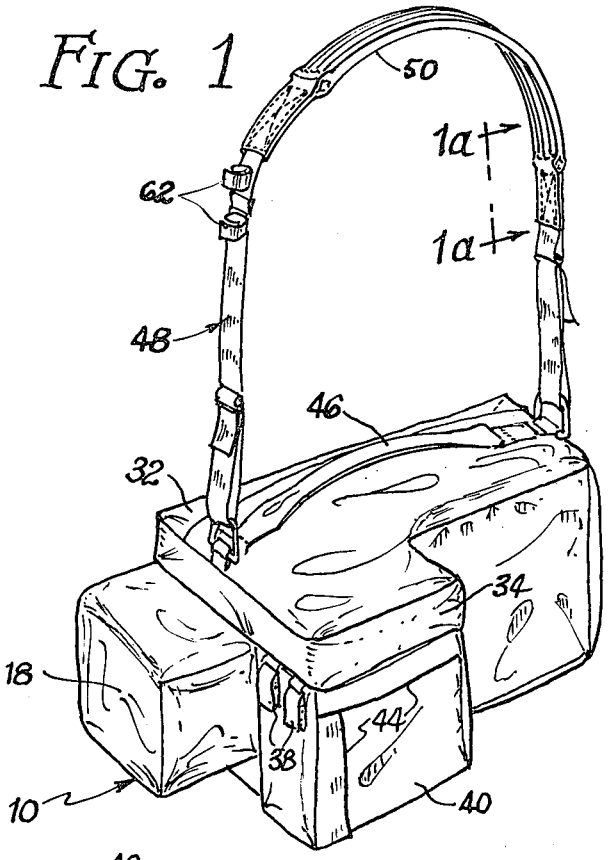
FIG. 1 is a perspective view of the carrying case.

The case as illustrated in FIG. 1 has a main body portion 10 consisting of a frame 12, best seen in FIG. 7, an inner liner 14 best seen in FIG. 8, and an outer cover

16. The shape of the body is of course dictated by the frame shown in FIG. 7, the frame itself being shaped according to the dictates of camera construction. The liner conforms closely to the interior space defined by the frame, including extending out into the lens protector projection 18.

FIG. 8(*b*) illustrates the construction of both the liner and the cover wherein a central layer of half-inch foam 20 is captured between panels of tough, lightweight nylon cloth 22. Typically a stitch line such as indicated at 24 is used along fold lines between foam panels. On the side of the case which is open, a fabric flange 26 wraps over the outer frame members 28 to securely hold the liner within the frame. To further secure the liner, a belt 30 may be wrapped around the frame and through slotted openings in the liner as shown in FIGS. 8 and 8(*b*). The outer cover of the frame is a snug fit and has an openable side 32 permitting both the insertion and removal of a video camera, and the frame and liner. The fit is sufficiently snug however that there is no chance of the frame accidentally coming free of its cover.

The cover conforms not only to the lens enclosure protrusion 18, but also a lateral extension 34 which accommodates the viewfinder of the camera. This extension is used to advantage by providing it with loops 36 which are engaged by Velcro straps 38 which are connected to an accessory pouch 40, which is useful for holding extra video cassettes or cables and the like. The pouch is not only connected by the four upper straps 38 but is kept from flopping loosely against the body of the case by mating VELCRO patches 42.

Since there are not always accessories that need be carried with the camera, this pouch is conveniently removable by unfastening the straps and pulling it free of the VELCRO patches. The pouch has a double-zippered openable side to provide greater access to the accessories, and protective flaps 44 which cover the zippers. A similar construction is used on the openable side 32 of the cover, except that the two zippers of the cover can each be extended around three edges of the openable side for maximum convenience in use and accessibility to the camera.

The case is provided both with a hand-carrying strap 46 and a shoulder strap 48. The hand-carrying strap is a somewhat conventional adjustable Nylon strap, but the shoulder strap is of unique construction. It also utilizes an adjustable Nylon strap, but the strap is centrally interrupted and replaced with a shoulder pad 50. The shoulder pad consists of an outer sleeve of tough, anti-skid material 52 which forms into a sleeve and captures a band of high-density foam 54 therein. For added strength, a layer of fabric is glued around the foam, with the anti-slip sleeve 52 being then wrapped around the cloth and foam and attached thereto by longitudinal stitching 56 defining a series of parallel ribs.

Figure 1A:
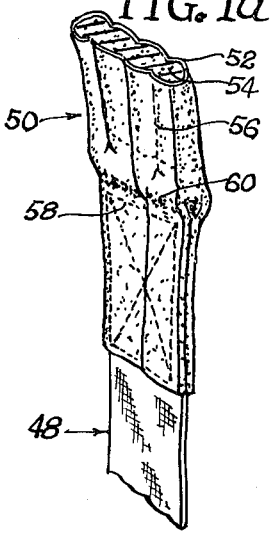
Figure 2:
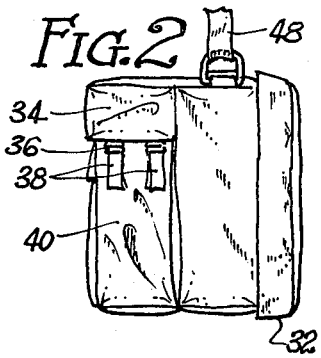
FIG. 2 is an end elevation view of the case.
Figure 3:
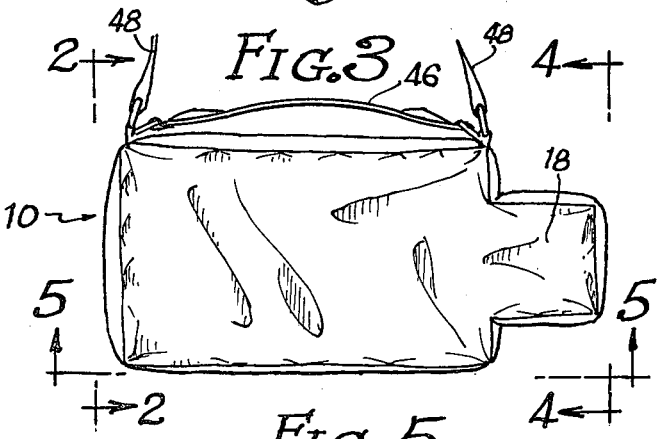
FIG. 3 is a side elevation view of the case.
Figure 4:
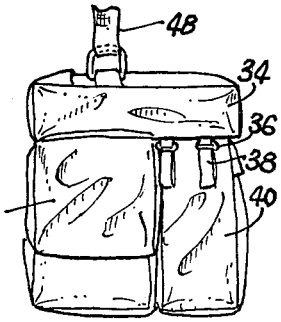
FIG. 4 is a view from the left end of the case as shown in FIG. 1.
Figure 5:
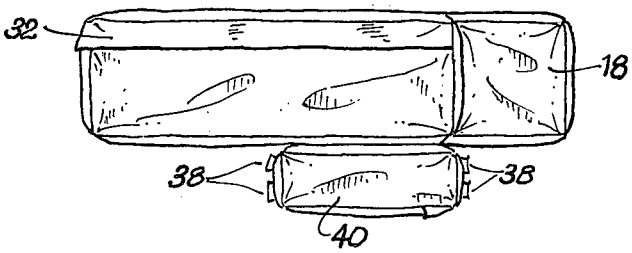
FIG. 5 is a bottom elevation view thereof.

A shock absorbing function is incorporated in the strap by virtue of the end portions of the shoulder pad. In these end portions, the foam terminates short of the end of the sleeve to provide an internal pocket 60 at each end of the foam between the end of the foam and the cross-stitching 58 which begins the stitching that captures the end of the Nylon band. This pocket, best shown in FIG. 1*a*, is normally bulged out because of the stiffness of the cloth. However, when under tension, the pocket will be pulled inwardly until the tension is released, so that a built-in shock cord effect is achieved.

This is possible because of the stiffness and resilience of the anti-skid material that is used for the shoulder pad.

Thus, another feature of the strap is the two VELCRO straps 62 which can hold a microphone, cables or the like.

Thus all in all, the case is ideal for the containment and transport of modern television cameras, and incorporates the latest in tough but lightweight fabric, foam protection, and an internal aluminum framing. By utilization of the case, it becomes virtually impossible to damage a portable television camera in the ordinary handling process.

While the preferred embodiment of the invention has been described, other modifications may be made thereto and other embodiments may be devised within the spirit of the invention and scope of the appended claims.

What is claimed is:

1. A case for a video camera comprising: a main body having:

a rigid frame shaped to substantially follow the contours of said camera;

an inner lining inside said frame for shielding said camera from said frame;

an outer covering over the exterior of said frame; means for carrying said case; an accessory pouch removably attached to said body; and wherein said body defines a laterally extended overhang and said pouch is fastened thereunder.

2. Structure according to claim 1 wherein said pouch fastens to the side of said body with hook-and-loop fastener material and to said overhang with hook-and-loop strap fasteners.

3. Structure according to claim 1 wherein said camera has a protruding lens system and said frame extends to define a protective enclosure for said lens system.

* * * * *